United States Patent [19]

Tsuji et al.

[11] Patent Number: 4,901,504

[45] Date of Patent: Feb. 20, 1990

[54] FILLING AND CASING SYSTEM

[75] Inventors: Mikio Tsuji; Kazuo Yoshitomi; Shingo Noro; Masayuki Hayashi; Hiroyasu Murase; Naoyoshi Kato; Kazunori Araki; Kenjiro Tanaka, all of Nagoya, Japan

[73] Assignee: Mitsubishi Jukogyo Kabushiki Kaisha, Tokyo, Japan

[21] Appl. No.: 180,896

[22] Filed: Apr. 13, 1988

[30] Foreign Application Priority Data

Apr. 13, 1987 [JP] Japan ..... 62-90404
May 29, 1987 [JP] Japan ..... 62-131251

[51] Int. Cl.[4] ..... B65B 7/28; B67B 3/20; B67B 7/18

[52] U.S. Cl. ..... 53/247; 53/249; 53/299; 53/282; 53/308

[58] Field of Search ..... 53/539, 381 A, 382, 53/306, 299, 308, 249, 247, 282, 266 R

[56] References Cited

U.S. PATENT DOCUMENTS

| | | | |
|---|---|---|---|
| 3,185,328 | 5/1965 | Dardaine et al. | 53/539 X |
| 3,555,770 | 1/1971 | Rowekamp | 53/247 X |
| 3,555,773 | 1/1971 | Rowekamp | 53/539 |
| 3,820,305 | 6/1974 | Van deer Meer | 53/308 |
| 3,938,847 | 2/1976 | Peyton | 53/247 X |
| 4,118,914 | 10/1978 | Shields | 53/282 |
| 4,300,330 | 11/1981 | Hartness | 53/539 |

FOREIGN PATENT DOCUMENTS

| | | | |
|---|---|---|---|
| 2544281 | 10/1984 | France | 53/247 |

*Primary Examiner*—Horace M. Culver
*Attorney, Agent, or Firm*—Wenderoth, Lind & Ponack

[57] ABSTRACT

An improved filling and casing system is disclosed herein, which comprises a case conveying device for conveying cases, a carrier conveying device disposed adjacent to and in parallel to the case conveying device for conveying carriers capable of accommodating and holding containers, an uncasing station including a container gripper movable between the case and the carrier for taking out the containers from the case and accommodating them in the carrier, a filling station including a filling head for performing a filling operation for the containers accommodated and held in the carrier, and a capping station including a capping head for performing a capping operation for the filled containers. The uncasing station, the filling station and the capping station are disposed in succession along the case conveying device and the carrier conveying device. An improved capping machine available in the capping station of the above-described filling and casing system, and an improved container gripper device available in the uncasing station as well as a casing station of the above-described filing and casing system, are also disclosed herein.

4 Claims, 12 Drawing Sheets

FILLING AND CASING SYSTEM

BACKGROUND OF THE INVENTION

1. Field of the Invention

The present invention relates to a filling and casing system applicable to a filling and casing line for filling bottles or the like with liquid, powder or the like such as food, detergent, oil, etc. and placing the bottles in a case, and a capping machine and a container gripper device in that system.

2. Description of the Prior Art

One example of a bottling system in the prior art is illustrated in FIG. 14. Briefly explaining the illustrated system, various kinds of instruments and a lot of operators therefor are necessitated by that system since an uncaser 3 for removing cleaned empty bottles 2 from a case 1, an aligning device 4 for carrying the taken-out bottles 2 and aligning the bottles 2 in one row, a bottling machine 5 for filling the aligned and carried-in bottles 2 with liquid, a capper 6 for capping the filled bottles 2, a case packer 7 for packing the bottles 2 in case 1, a case conveyor 8 for conveying empty cases discharged from the uncaser 3 to the case packer 7, and conveyors for connecting the respective instruments with one another, are employed.

In other words, along the flow of the bottles 2 are the uncaser 3 → the aligning device 4 → a conveyor 9 → the bottling machine 5 → the capper 6 → a conveyor 10 → the case packer 7, while with respect to the flow of the cases 1, the empty cases 1 discharged from the uncaser 3 must be conveyed by a long case conveyor 8 until the bottles 2 are packed in these cases 1 by the case packer 7. In addition, respective operators are always necessary for each of the instruments including the uncaser 3, the bottling machine 5, the capping 6, and the case packer 7 because the distances between the respective instruments are so long that it is impossible for only one operator to monitor and operate these instruments.

More particularly, in the heretofore known system, the respective operations are performed by the respective machines exclusively (for instance, the uncaser is exclusively used for taking bottles from a case, or the like), and the operations are performed independent of one another. For instance, the uncaser 3 operates continuously, the bottling machine 5 operates continuously, but the case packer 7 operates intermittently, and in order to synchronize these operations with each other, conveyors are essential between the respective machines.

While the uncaser 3 and the case packer 7 process a predetermined plurality of containers, such as bottles, at the same time, the bottling machine 5 processes the containers one by one. In order to feed the containers to the bottling machine 5, the aligning device 4 for aligning the containers in one row is required; and, in front of the case packer 7 another aligning device for realigning the containers in one row conveyed by the conveyor 10 into a plurality of rows is required.

In this way, the respective machines are connected via conveyors, and since there are considerable distances between the respective machines, it is necessary to provide persons for monitoring and operating the machines.

Furthermore, in the heretofore known system, if the size of the containers to be handled is changed, it is necessary to mount new devices capable of handling the containers. Hence, a number of devices must be prepared for different containers, and it takes a long time to exchange the devices.

In summary, the above-described type of filling and casing system in the prior art presents problems in that machines operating individually to perform respective operations are connected via conveyors and the flow of containers is regulated to that end; hence the productivity of the system is poor, a large space and many operators are necessary, and further it is impossible to immediately accommodate for a change in the containers.

In particular, the filling and casing system in the prior art presents a problem in that when processing containers such as bottles having different sizes, it is necessary to mount a container gripper adapted to the containers to be processed; hence the number of container gripers to be used is large, and also a lot of time is necessary for exchanging the container grippers. In addition, there is a problem in that a bottle aligning device is necessary, and in particular, when handling containers having eccentric container mouths, an aligning device is necessary downstream of a casing machine, because container grippers are matched with a pitch of containers arrayed in a case on the conveyor.

SUMMARY OF THE INVENTION

It is therefore one object of the present invention to provide a novel filling and casing system in which the aforementioned problems in the prior art have been resolved and the processing in each step in the filling and casing system can be effectively achieved case by case.

Another object of the present invention is to provide a novel capping machine available in the above-described novel filling and casing system, which machine can effect capping in a plurality of rows by making use of a single cap aligning machine.

Still another object of the present invention is to provide a novel container gripper device available in the above-described novel filling and casing system, which gripper device can be easily adapted to accommodate for containers having different sizes within a short period of time.

According to one feature of the present invention, there is provided a filling and casing system comprising a case conveying device for conveying cases, a carrier conveying device disposed adjacent to and in parallel to the case conveying device for conveying carriers capable of accommodating and holding containers, an uncasing station including a container gripper movable between the case and the carrier for taking containers from the case and placing them in the carrier, a filling station including a filling head for filling the containers accommodated and held in the carrier, and a capping station including a capping head for capping the filled containers.

According to another feature of the present invention, there is provided a capping machine of the above-featured filling and casing system, which machine comprises a cap feeding device for successively feeding caps to cap pickers adapted to support the caps respectively, and a cap take-out device including the cap pickers, in which the cap pickers are movable between positions associated with the feeding of the caps and with the capping of the containers in the carrier for accommodating and conveying the containers.

According to yet another feature of the present invention, there is provided a capping machine in which the cap feeding device feeds caps to a plurality of cap take-out devices by means of a divided chute to facilitate capping in a plurality of rows by making use of a single cap aligning machine.

According to still another feature of the present invention, there is provided a container gripper device available in the first-featured filling and casing system, which device comprises a grip block device which automatically sets different gripper intervals when it is placed above the case conveying device and when it is placed above the carrier conveying device, and which device includes a rotary device for rotating the grip block device by 9020 in clockwise and counterclockwise directions.

According to the present invention, a case conveying device and a carrier conveying device are disposed parallel to each other, and while the respective conveying devices are operating, a series of operations such as the transfer of empty containers from a case to a carrier, the filling of the containers, the capping of the containers, the return of the filled containers from the carrier to the case and the sealing of the cases are carried out continuously while maintaining a timing therebetween.

As a result, the whole system is comparatively simple as many conveyors for connecting the respective instruments and many aligning devices which were necessary in the prior art can be dispensed with, the distances between the respective instruments are comparatively short, monitoring and manipulation of the respective instruments is easy, and when changing the type of containers to be handled, relatively few component parts of the instruments need to be replaced, and the time necessary for exchanging the component parts is comparatively short.

In the capping machine according to the present invention, when a unit of a plurality of containers arrayed in a plurality of rows and accommodated in a conveying box is capped, aligned caps are fed to cap pickers via a divided chute, and when the caps are taken from the cap pickers and fastened to the containers, the positions of the cap pickers have been moved, so that capping of the containers can be effected smoothly. In addition, the capping machine can be adapted to change an array of containers in a container accommodating conveying box by changing the array of the cap take-out pickers for taking caps from the outlet of the chute.

Furthermore, in the container gripper device according to the present invention, the spacing between the container grippers is increased or decreased in the left and right directions by actuating a cylinder extending in the left and right directions in the grip block device. Also, the spacing between the container grippers is increased or decreased in the back and forth directions by actuating a cylinder extending in the back and forth directions. In addition, the grip block device can be rotated by 90° in the clockwise or counterclockwise direction by means of a rotary device making use of an electric motor or the like.

The above-mentioned and other objects, features and advantages of the present invention will become more apparent by reference to the following description of preferred embodiments of the invention taken in conjunction with the accompanying drawings.

DETAILED DESCRIPTION OF THE PREFERRED EMBODIMENTS

Figure 1:
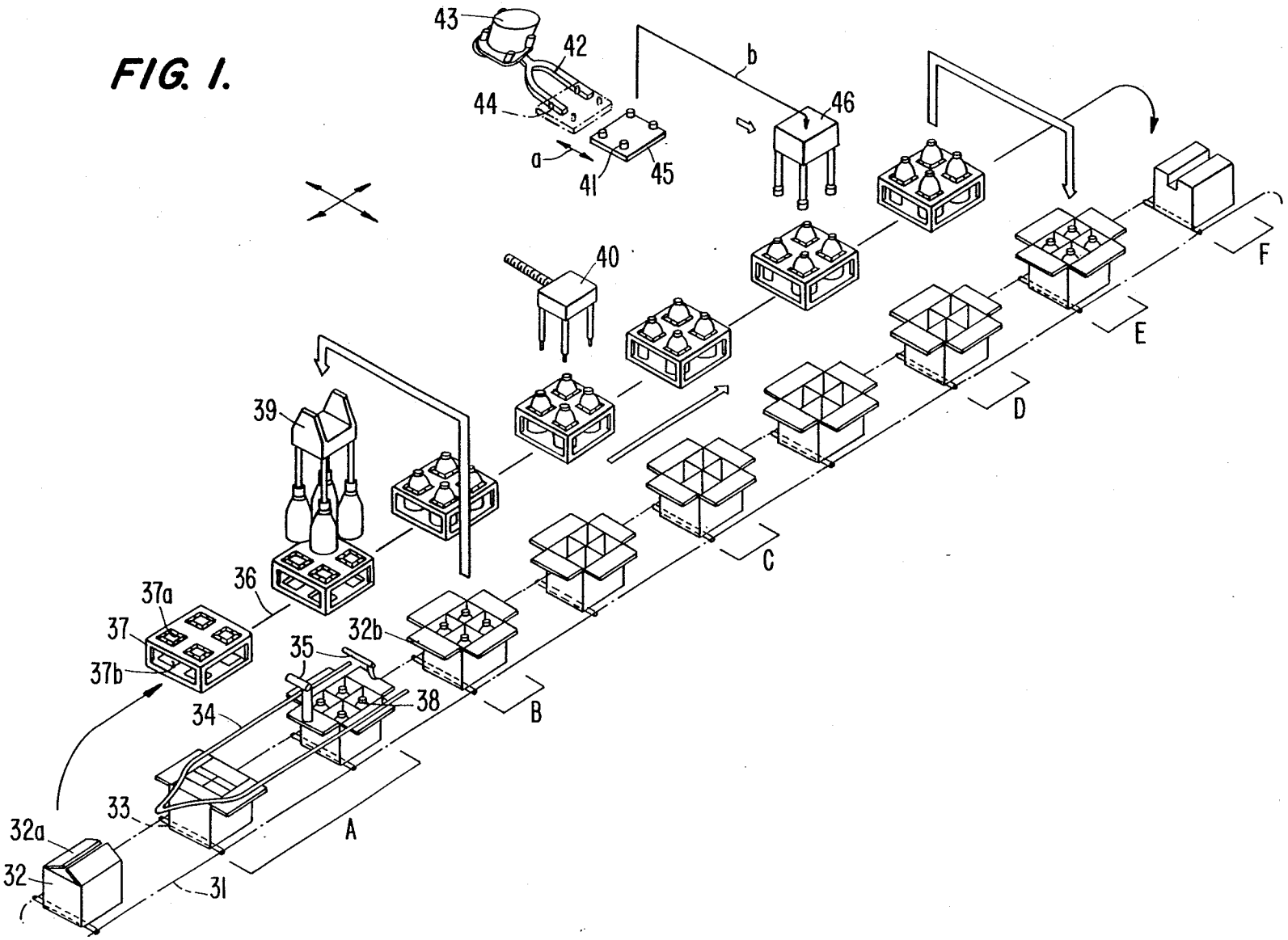
FIG. 1 is a perspective view showing the general structure and an outline of the operation of a filling and casing system according to one preferred embodiment of the present invention.

Now the preferred embodiments of the present invention will be described with reference to the accompanying drawings. A line for filling bottles with liquid according to one preferred embodiment of the present invention is illustrated in FIG. 1, wherein reference numeral 31 designates an endless type of case conveying device, and this case conveying device 31 has such structure that the rear of a case 32 is pushed by a push rod 33 to convey the cases 32 while being spaced by a predetermined interval, and is driven intermittently by a driving device not shown. Proximately above an inlet of the case conveying device 31 is provided a plow-shaped left and right flap opener device 34 which is fixed to a frame not shown, and by which left and right flaps 32*a* of the case 32 can be opened. On the downstream side of the left and right flap opener device 34 is disposed a front and rear flap opener 35 which opens front and rear flaps 32*b* of the case 32 when rotated in the clockwise or counterclockwise direction by means of a driving device not shown. The flap opener devices 34 and 35 are disposed at a flap open station A. With the front and rear flaps 32*b* and the left and right flaps 32*a* are kept opened, the cases 32 are successively conveyed towards a casing station E.

A carrier conveying device 36 is disposed parallel to the case conveying device 31, and the former conveys movable type of carriers 37 intermittently in synchronism with the case conveying device 31 as driven by a driving device not shown. A pitch of pockets 37*a* of this carrier 37 is equal to or larger than the pitch in the longitudinal and lateral directions at which the containers 38 are spaced in the case 32, and these pockets 37*a* and/or their bottoms 37*b* have such structure that they unrotatably hold the containers 38 upon the receiving, filling or capping of the containers 38. The movable type of carriers 37 are adapted to be conveyed to the respective stations by the carrier conveying device 36. Accordingly, while the case conveying device 31 and the carrier conveying device 36 are moving intermittently from the left to the right as viewed in FIG. 1, the cases 32 and the movable type carriers 37 are conveyed successively through the flap open station A, an uncasing station B, a filling station C, a capping station D, the casing station E and a seal station F, respectively.

In the uncasing station B downstream of the flap open station A, a container gripper 39 that is movable in the vertical directions and in the back and forth directions, is disposed. For the container gripper 39, a known gripper in the prior art or the novel container gripper according to the present invention as will be described later can be used, and in either case the container gripper 39 is adapted to grab the containers 38 from the case 32 and to place them in the pockets 37*a* of the movable type carrier 37 that has been moved up to that station with the case 32.

At the filling station C, a known filling head 40 in the prior art (having the same number of head elements as the number of containers 38 in one case) can be used, and this filling head 40 is adapted to fill the containers 38 with liquid by moving up and down.

Next to the filling station C is disposed the capping station D, and at this station D are disposed a vibration type aligning device 43 which aligns caps 41 along a predetermined direction and conveys them in two rows through a forked chute 42, a cap take-out device 45 provided with a plurality of cap pickers 44 (in the illustrated embodiment, four cap pickers 44 are provided) for taking out the caps 41 one by one from the tip ends of the forked chute 42 by moving laterally in the direction of arrows a, and a capping head 46 that is movable between the cap take-out device 45 and the movable type of carrier 37 as shown by an arrowed line b. The above-mentioned cap take-out device 45, after the caps 41 mounted on the cap pickers 44 have been removed by the capping head 46, returns to a predetermined position with respect to the vibration type aligning device 43.

The capping head 46, after it has removed the caps 41 from the cap take-out device 45, rises, then moves towards the carrier conveying device 36 above the movable type of carrier 37 and subsequently lowers towards the containers 38 accommodated in the same carrier 37 as shown by an arrowed line b, is centered with the respective containers 38, and then rotationally fastens the caps 41.

Next to the capping station D is disposed the casing station E, at which the containers 38 accommodated in the movable type of carrier 37 are gripped by a container gripper (not shown), similar to the container gripper 39 in the uncasing station B, which rises and moves towards the case conveying device 31 to thereby place the containers 38 in an empty case 32.

Downstream of the casing station E is disposed the seal station F, and at this seal station F the case 32 in which the containers 38 have been packaged can be sealed by means of a sealing device (not shown). It is to be noted that the container gripper 39, the filling head 40 and the capping head 46 are constructed in such a manner that the pitches of the respective gripper elements, the filling head elements and the capping head elements can be varied depending upon the accommodating pitch of the case 32 and the movable type of carrier 37 in which the containers 38 are accommodated.

Now explaining the operation of the filling and casing system constructed in the above-described manner, the cases 32 fed one by one are conveyed successively and intermittently by the case conveying device 31 through the flap open station A, the casing station B, the filling station C, the capping station D, the casing station E and the seal station F while maintaining a predetermined interval therebetween, and upon the stoppage of the case conveying device 31 and the cases 32 thereon, the respective operations are carried out at the respective stations.

The carrier conveying device 36 is advanced intermittently at a predetermined pitch through the above-described respective stations successively as synchronized with the aforementioned case conveying device 31, and the respective operations are carried out at the corresponding stations. However, it is to be noted that the feed pitches of the case conveying device 31 and the carrier conveying device 36 need not always coincide with each other.

In the system according to the illustrated embodiment, the filling of the containers with liquid and the packaging thereof are carried out in the following manner:

(1) When a case 32 having flaps is fed, the left and right flaps 32*a* and the front and rear flaps 32*b* are opened at the flap open station A. More particularly, the left and right flaps 32*a* are opened by the left and right flap opener device 34, and the front and rear flaps 32*b* are opened by the front and rear flap opener device 35. While corrugated cardboard cases having flaps are shown in the illustrated embodiment, when the cases have no flaps, the station A is unnecessary.

(2) The case 32 having its flaps opened is sent to the uncasing station B at a predetermined pitch. At the uncasing station B, the container gripper 39 grips one case of containers 38, that is, four containers 38 en bloc and rises, and then the containers 38 gripped by the gripper 39 are accommodated in an empty movable type of carrier 37 which has been moved to the station B parallel to the case 32.

The movable type of carrier 37 is formed so as to have a somewhat larger alignment pitch than the alignment pitch of the containers 38 accommodated in the case 32, and so, the carrier 37 serves to prevent interference between the various head elements when the respective operations are carried out at the successive stations. In addition, the size of the pockets 37*a* of the movable type of carrier 37 is somewhat larger than the size of the containers 38 so that the container 38 can be easily accommodated in the movable type of carrier 37. Moreover, the shape of the pockets 37*a* is such that after the container 38 has entered the pocket 37*a* it can be surely held so that the position of the container 38 within the pocket 37*a* may not be shifted during movement of the movable type of carrier 37.

The empty cases 32 are successively sent to the respective succeeding stations, and eventually they are conveyed through the casing station E up to the seal station F.

(3) After the containers 38 have been accommodated in the movable type of carriers 37, the carriers 37 are sent to the filling station C at predetermined intervals, and when each carrier 37 stops at the filling station C, the filling head 40 which has been in a standby state is lowered and the respective head elements are positioned just above the mouths of all the containers 38 so that the containers 38 can be simultaneously filled with liquid. After filling, simultaneously with the raising of the filling head 40, the filled containers 38 are conveyed to the next capping station D as carried by the movable type of carrier 37.

(4) The caps 41 are aligned via the vibration type aligning device 43 and are delivered as aligned in two rows by the forked chute 42, and at the outlets of the chute 42 the caps 41 positioned at the tip ends of the chute 42 are mounted on the cap pickers 44 by the cap take-out device 45 which has been held in a standby state.

The cap take-out device 45 having the caps 41 mounted thereon is moved to the position depicted by solid lines. Here, the capping head 46 having elements spaced at the same pitch as the pitch of the containers 38 accommodated in the movable type of carrier 37, is lowered from above the cap take-out device 45 occupying the above-mentioned position, and holds the caps 41. When the capping head 46 takes hold of the caps 41, the cap take-out device 45 returns to the side of the cap aligning device 43.

After the capping head 46 holding the caps 41 has moved to a position above the movable type of carrier 37, it lowers to fit the caps 41 to the mouths of the containers 38, and then it rotationally fastens the caps 41 to the containers. As the respective head elements of the capping head 46 rotate during this rotational fastening, the containers 38 are fixedly held by the movable type of carrier 37 so that they may not be rotated with the rotating capping head elements.

(5) When the capping of the containers 38 has been finished, the movable type of carrier 37 is conveyed to the subsequent casing station E, where the containers 38 are taken out from the movable type of carrier 37 by means of a container gripper (not shown) that is similar to the container gripper 39 used in the uncasing station B, then they are packaged in an empty case 32 held in a standby state on the case conveying device 31, and the packaged case is sealed at the next seal station F. The emptied movable type of carrier 37 is conveyed back to the flap open station A at the inlet of the filling and casing line.

Since the filling and casing system according to the present invention has the above-described structure, when switching to a different type of container, it suffices only to change the component parts such as the parts of the movable type of carrier, the filling head and the capping head, the gripper elements of the container gripper or the like depending upon the size and configuration of the container.

Next, one preferred embodiment of the capping machine according to the present invention which can be used in the above-described filling and casing system according to the present invention, will be explained with reference to FIGS. 2 to 7 of the accompanying drawings.

Figure 2:
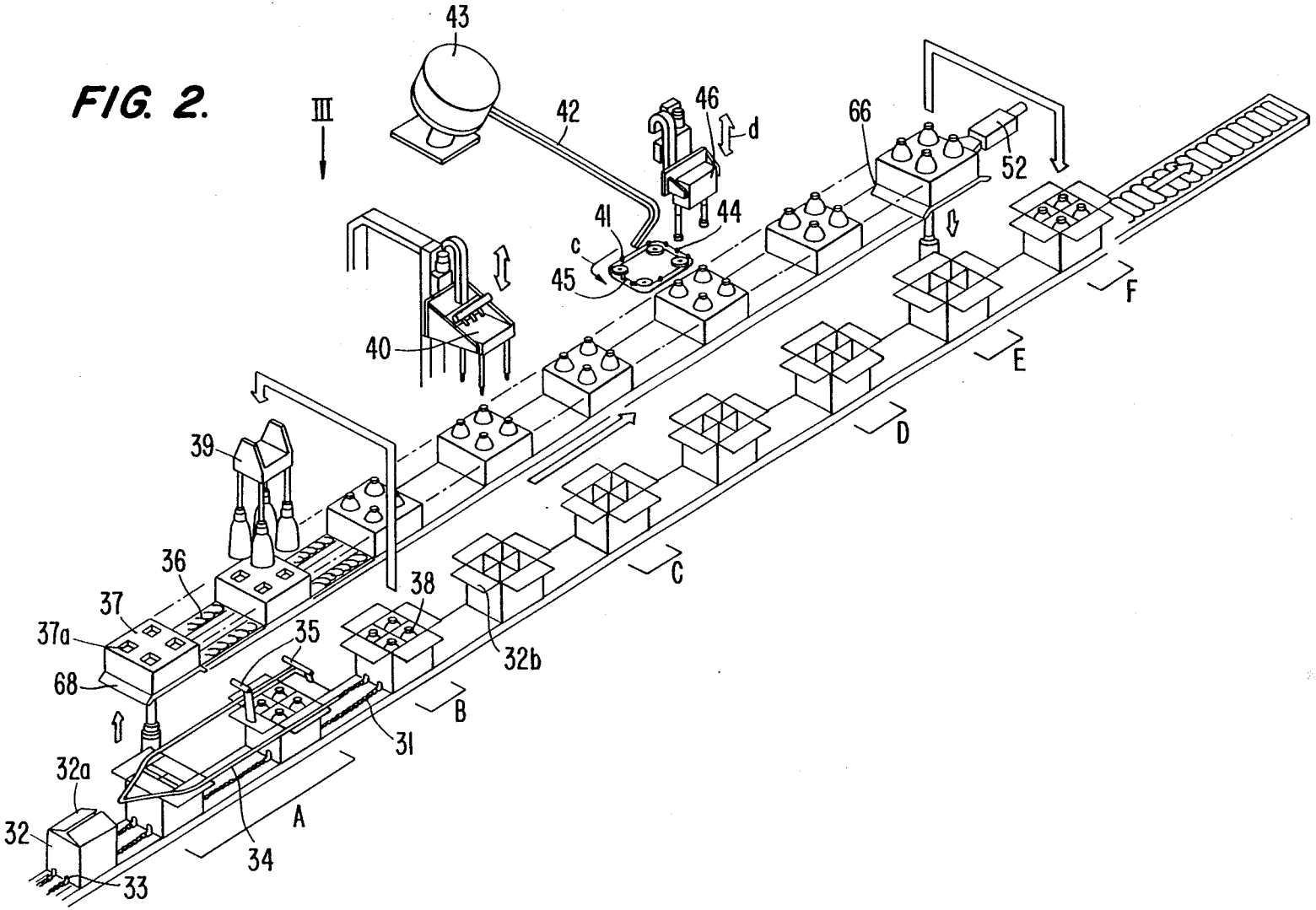
FIG. 2 is a perspective view showing the general structure and an outline of the operation of a filling and casing system according to another preferred embodiment of the present invention, in which a novel capping machine according to the present invention is employed.
Figure 3:
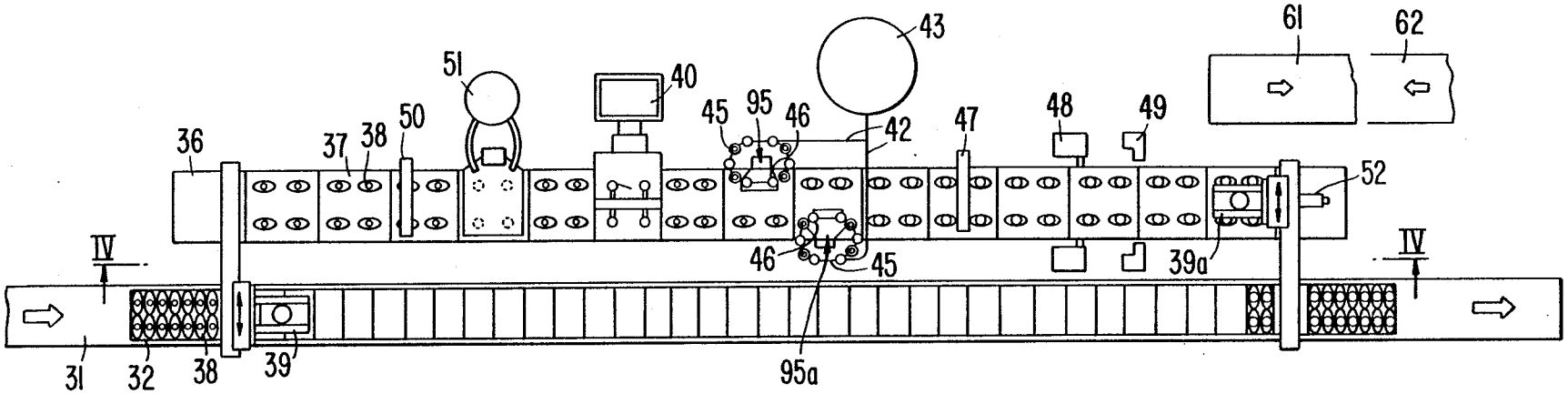
FIG. 3 is a plan view of the filling and casing system shown in FIG. 2 as viewed in the direction of an arrow III in FIG. 2.
Figure 4:
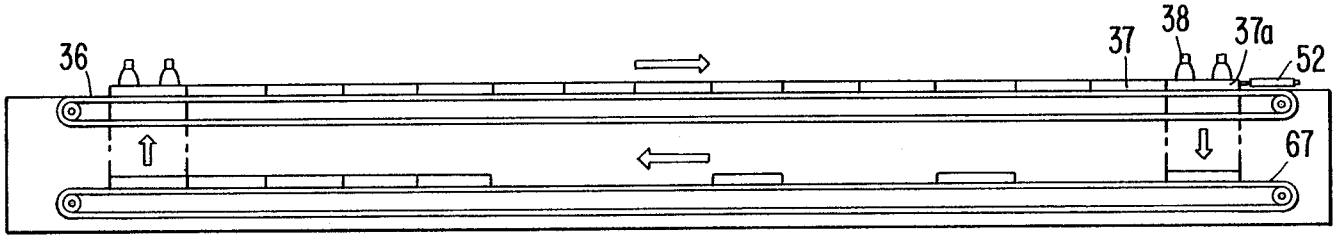
FIG. 4 is a front view of the same filling and casing system as viewed in the direction of an arrow IV in FIG. 3.
Figure 5A:
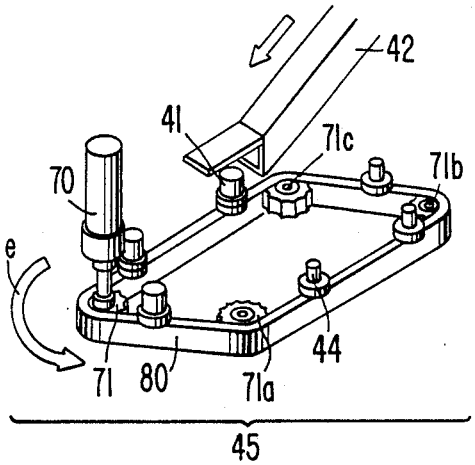
FIGS. 5(*a*), 5(*b*), 5(*c*) and 5(*d*) are perspective views showing different operating states in succession, respectively, of a cap take-out device.
Figure 5B:
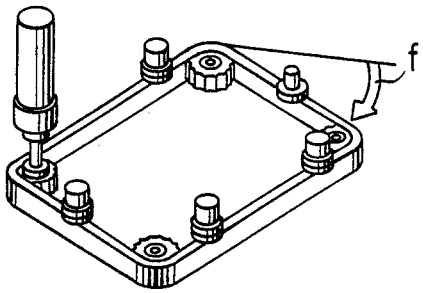
Figure 5D:
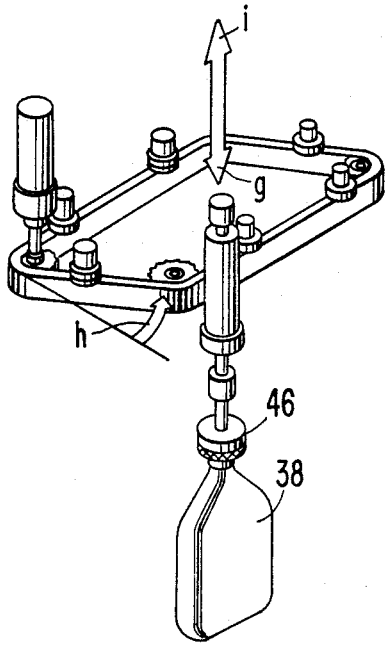
Figure 5C:
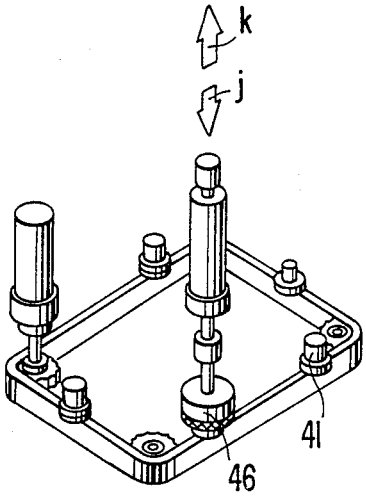

FIGS. 2 and 3 illustrate a filling and casing line for filling bottles with liquid, and since the structure thereof is similar to that of the line shown in FIG. 1 up to the filling station C, further explanation of the similar portion will be omitted here. However, it is to be noted that in this line the movable type of carriers 37 are conveyed by a carrier conveying device 36 while they are held in contact with one another, as opposed to the embodiment of FIG. 1, but for clarity of illustration, some of the carriers 37 are indicated only by their contours depicted by double-dot chain lines.

Downstream of the filling station C is a capping station D, and at the capping station D are arranged an aligning device 43 which aligns caps 41 along a predetermined direction and conveys them in two rows along a forked chute 42 (see FIG. 3 as FIG. 2 shows only a portion of the chute on one side of the carrier conveying device 36), a cap take-out device 45 in which a plurality of (four in the illustrated embodiment) cap pickers 44 for taking the caps 41 one by one from the tip end of each branch of the chute 42 while moving horizontally in the direction of an arrow c, and a capping head 46 that is movable in the directions of arrows d. The cap take-out device 45 operates such that after the caps 41 mounted on the cap pickers 44 have been taken therefrom by the capping head 46, it may be returned to a predetermined position where it does not interfere with the vertical movement of the capping head 46.

After the capping head 46 has taken the caps 41 from the cap take-out device 45, it moves towards the carrier conveying device 36 to a position above the movable type of carrier 37. Subsequently it descends towards the containers 38 accommodated in the same carrier 37, and when the centers of the respective head elements in the capping head 46 are aligned with the centers of the containers 38, rotational fastening of the caps 41 is effected.

At locations downstream of the capping station D are a capped state detector 47, a laser printing machine 48 for printing a lot number and the like on the containers, a weight checker (not shown) and a printing inspector 49 for inspecting a printed condition (see FIG. 3). Downstream of a weight-check and printing station E is provided a casing station F, where the containers 38 accommodated in the movable type of carrier 37 and held in a regular state are gripped by a container gripper 39*a* (see FIG. 3) similar to the container gripper 39 in the uncasing station B. Then the gripper 39*a* rises and moves towards the case conveying device 31 so as to place the containers 38 in an empty case 32.

Downstream of the casing station F is a seal station (not shown), and at this station the case 32 packaged with the containers 38 is sealed by means of a sealing device (not shown). It is to be noted that in the container grippers 39 and 39*a*, the filling head 40 and the capping head 46, the pitches between the respective gripper elements and between the respective head elements can be varied depending upon the accommodation pitch of the case 32 or the movable type of carrier 37 in which the containers 38 are accommodated.

In FIG. 3, reference numeral 50 designates a container detector device which checks the number of the containers 38 accommodated in the carrier 37, and reference numeral 51 designates an air cleaner for cleaning the interior of the containers 38 with air. In addition, reference numeral 52 designates a drawing device which is locked to the carrier 37*a* at the foremost end and intermittently conveys the carrier 37 for every pitch while performing necessary speed control (for instance, acceleration and deceleration of the carrier 37 is effected by always applying a braking action to the carrier 37 with respect to the carrier conveying device 36). Reference numeral 61 designates an unacceptable products ejecting conveyor for ejecting unacceptable products (for example, when containers are missing in a carrier, are not filled properly, have no cap, have an abnormal cap, or when the printing is abnormal, etc.) or for conveying away unnecessary carriers upon the changing of the type of containers, and reference numeral 62 designates a feed conveyor for feeding empty carriers.

Figure 6:
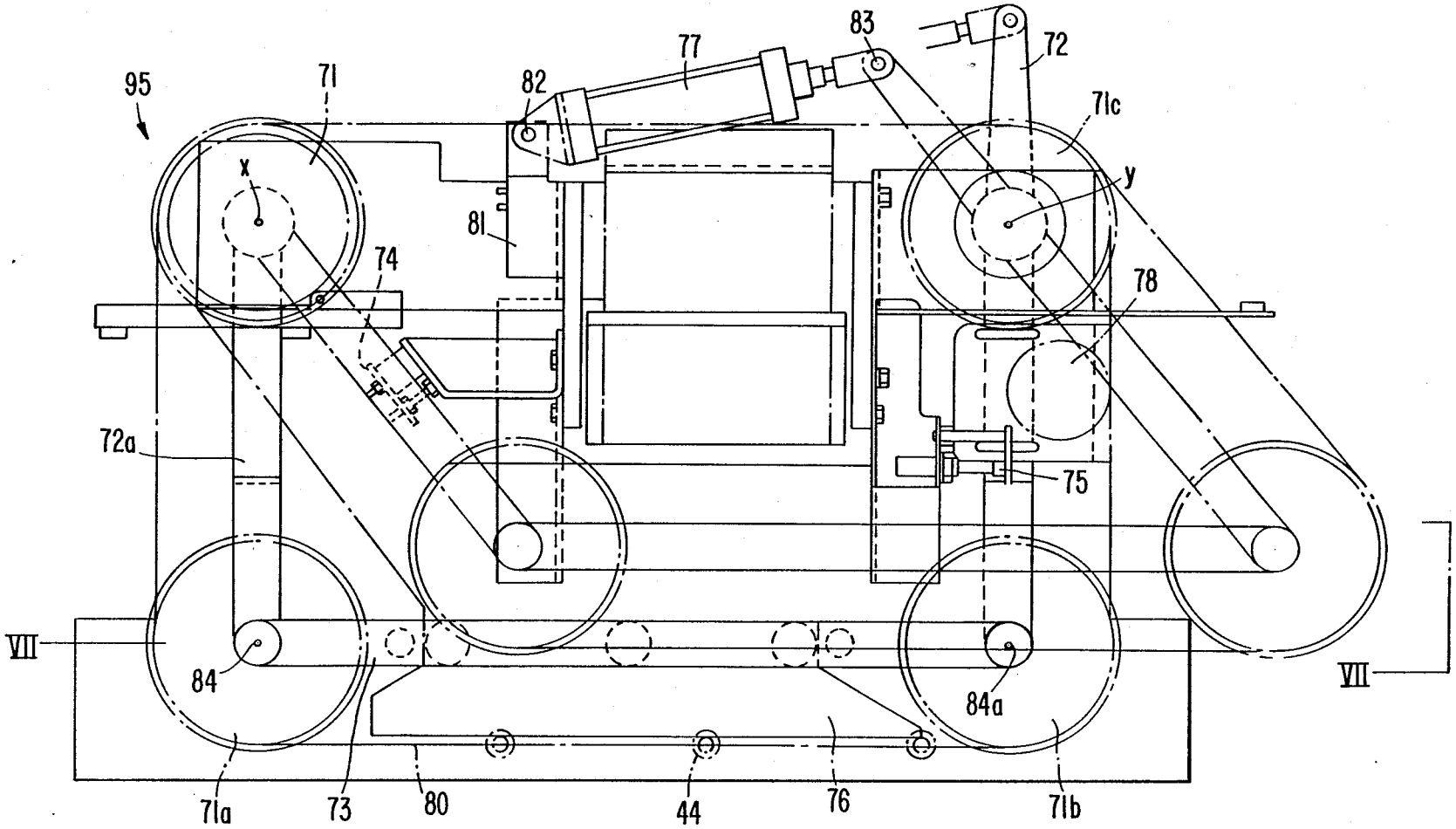
FIG. 6 is an enlarged plan view of the same cap take-out device.
Figure 7:
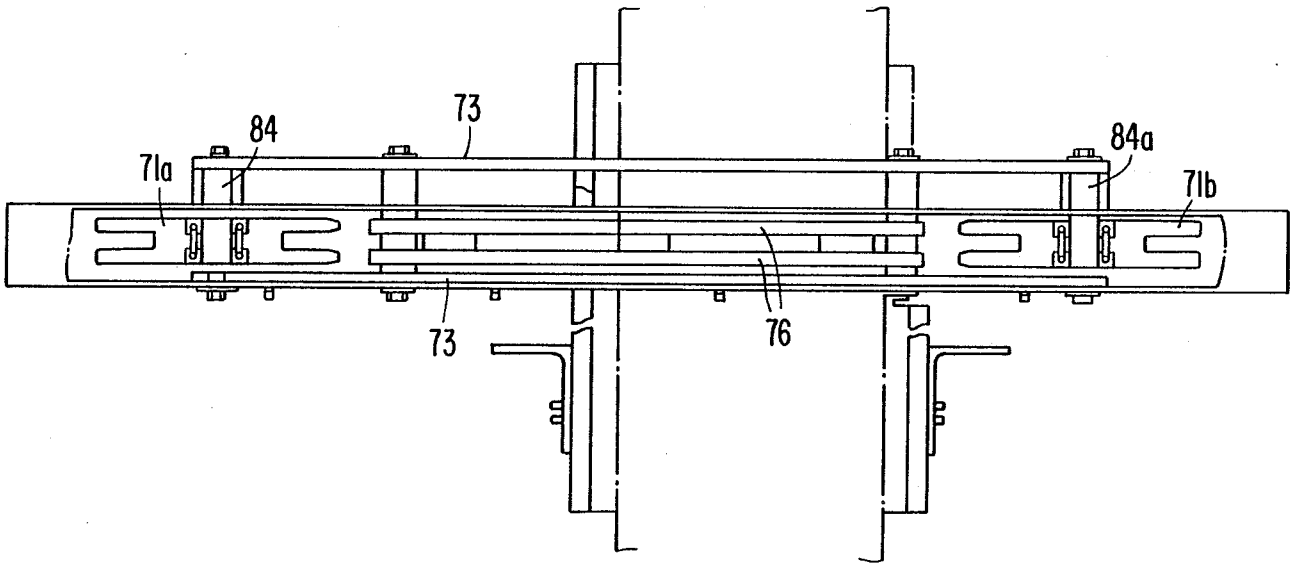
FIG. 7 is a cross-sectional view taken along line VII—VII in FIG. 6.
Figure 8:
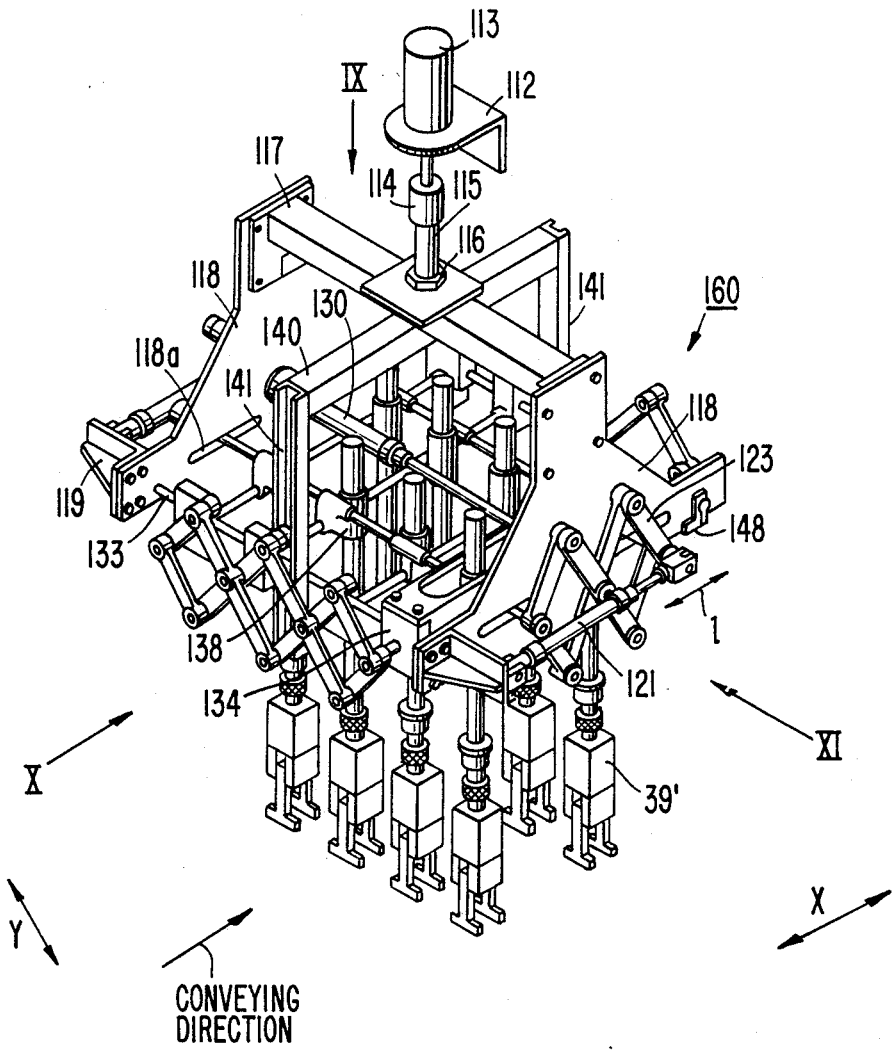
FIG. 8 is a perspective view of a grip block device in a container gripper device according to one preferred embodiment of the present invention.
Figure 9:
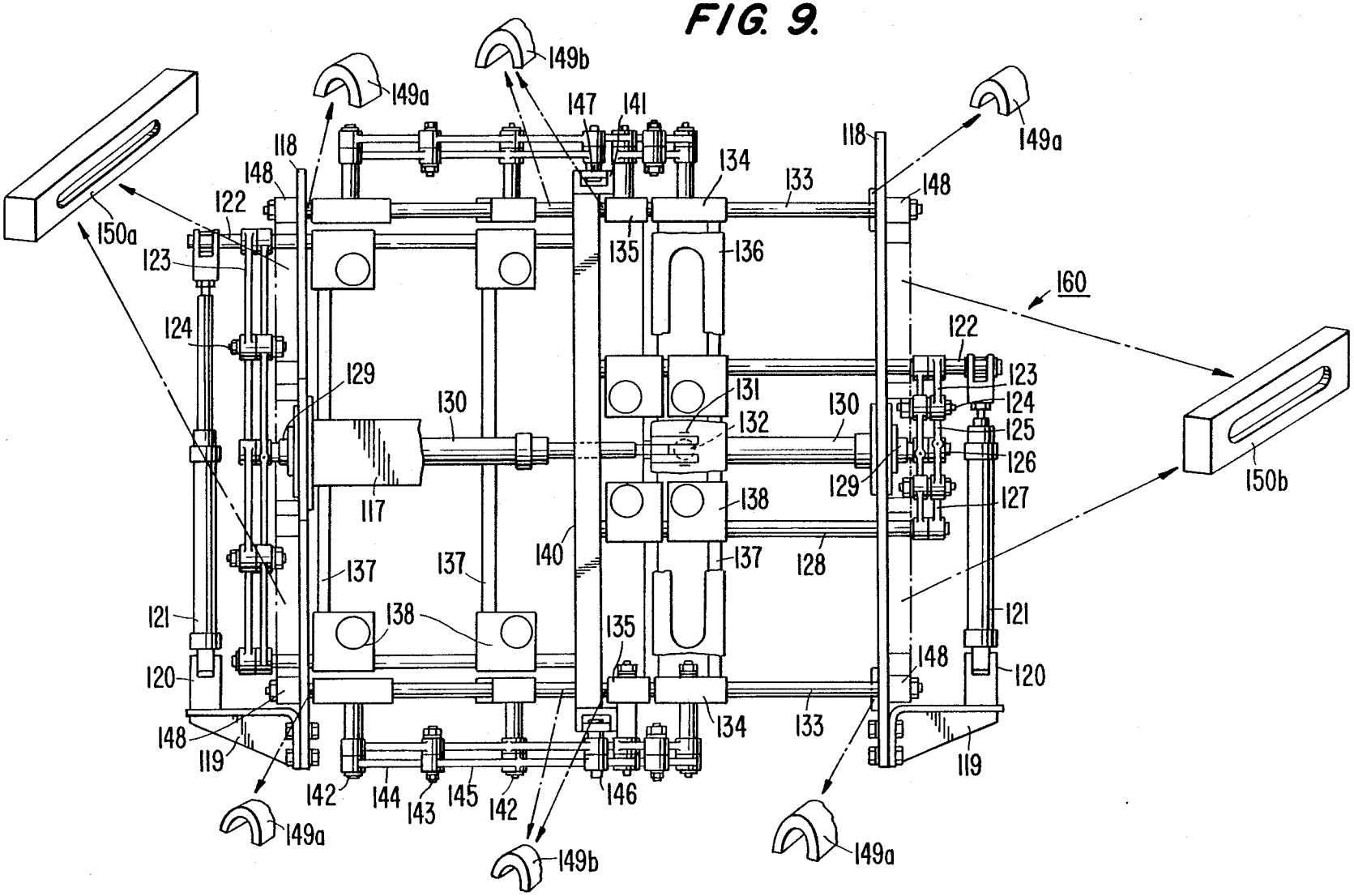
FIG. 9 is a plan view of the same grip block device as viewed in the direction of an arrow IX in FIG. 8.
Figure 10:
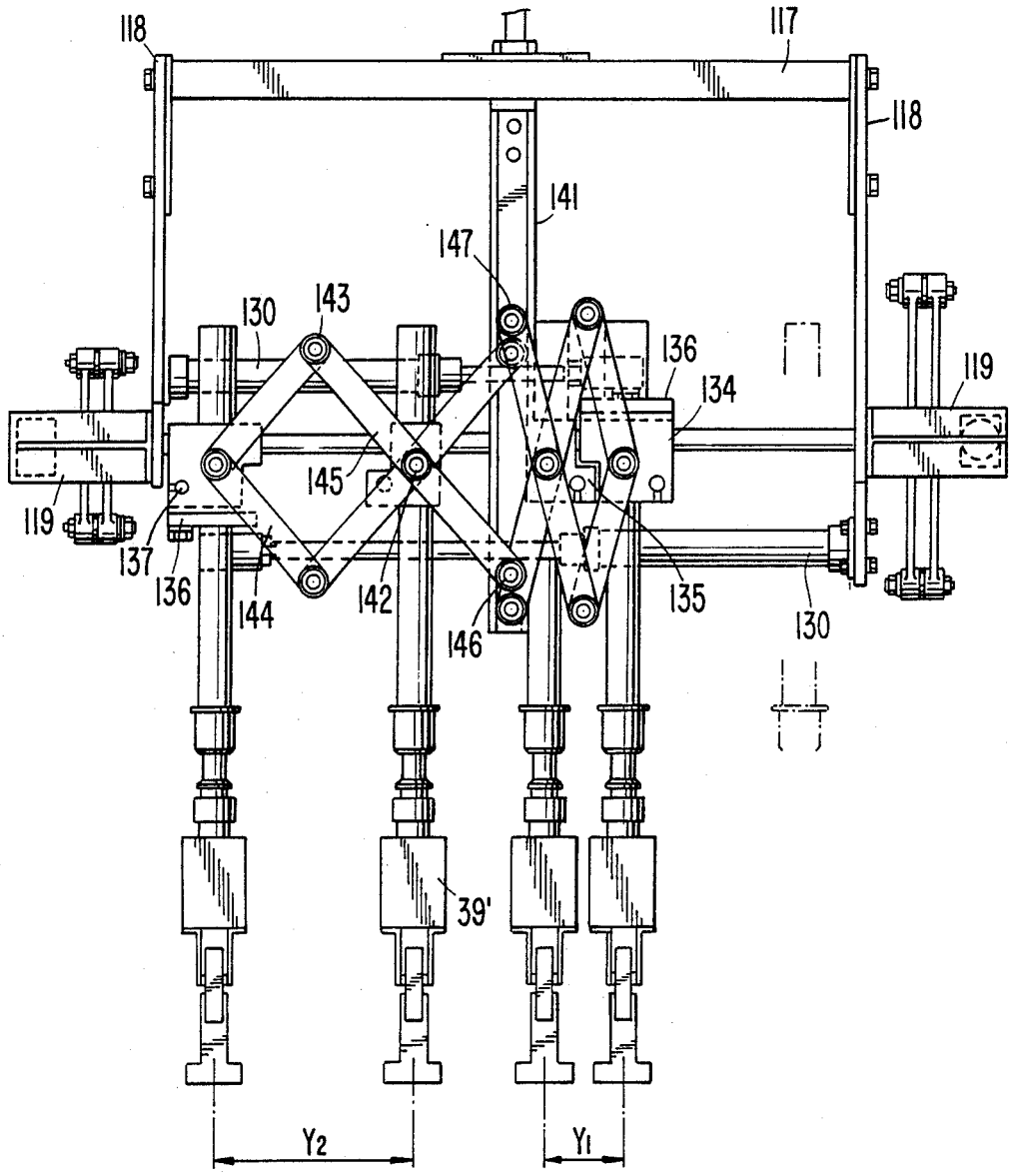
FIG. 10 is a side view of the same grip block device as viewed in the direction of an arrow X in FIG. 8.
Figure 11:
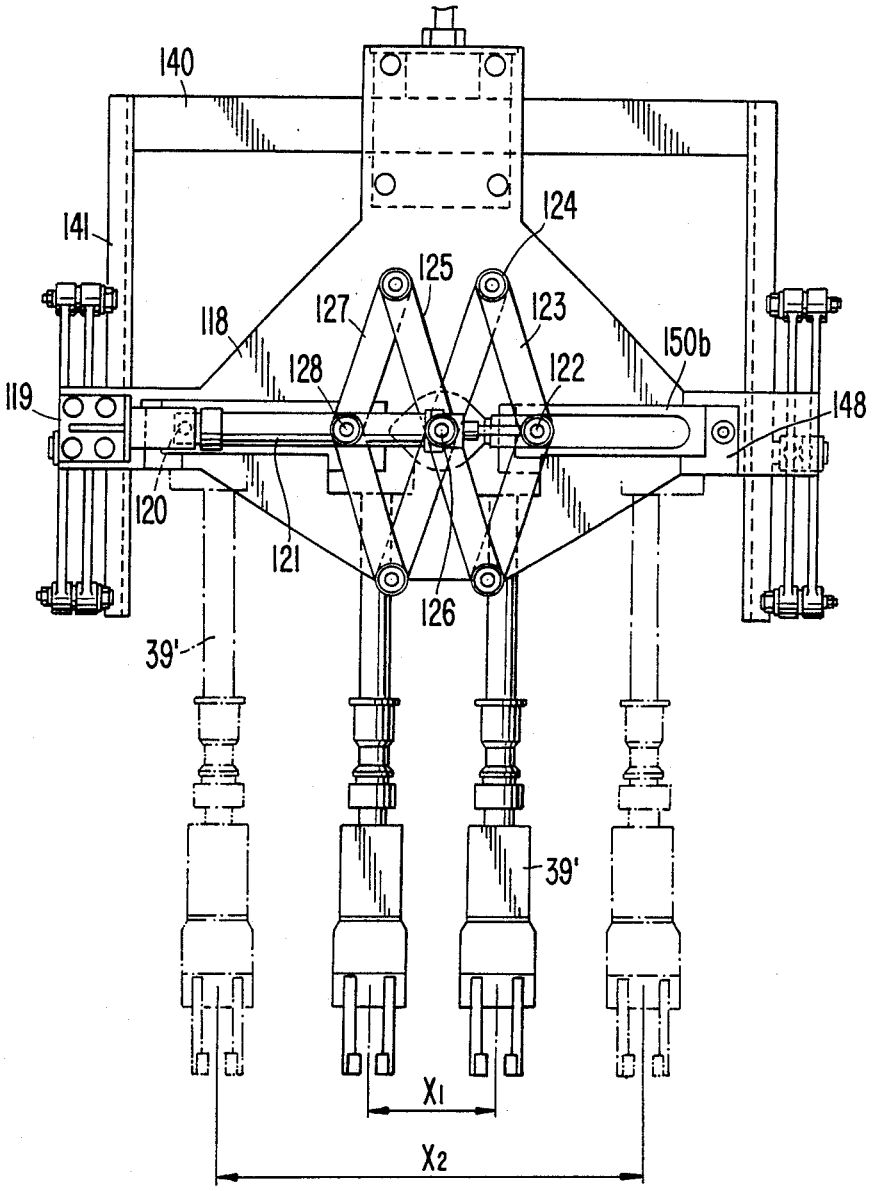
FIG. 11 is a front view of the same grip block device as viewed in the direction of an arrow XI in FIG. 8.

Now the detailed structure of the capping station D in the above-described filling and casing line will be described with reference to FIGS. 5, 6 and 7. At first, the cap take-out device 45 will be described. In FIGS. 5, 6 and 7, reference numeral 70 designates a motor that is held by a fixed bracket (not shown) and is connected to a driving side sprocket 71, which cooperates with driven side sprockets 71*a*, 71*b* and 71*c* to revolve cap pickers 44 for taking caps 41 from an outlet of a chute 42 and a conveying chain 80 for conveying the caps 41 in the direction of an arrow e in FIG. 5(*a*). The cap pickers 44 have a structure capable of being mounted on and dismounted from the chain 80, and they are integrally assembled with the chain 80. The number of cap pickers 44 mounted is determined by the number necessary for at least one cycle of capping (in the illustrated embodiment, in the case of 4 caps/cycle, 6 cap pickers corresponding to 3 stations are mounted), and in correspondence with the array of the containers. If the array in the carrier 37 is changed, the same cap take-out device can be adapted by changing the array of the cap pickers 44.

The above-described sprockets 71*a* and 71*b* are swingable about fulcrums at point x and point y, respectively, in FIG. 6. Also the sprockets 71*a* and 71*b* are connected via an arm 72*a*, a connecting bar 73 and an arm 72, and the assembly including the sprockets 71*a* and 71*b*, the arms 72 and 72*a* and the connecting rod 73 are connected such that by actuating an air cylinder 77, the assembly can be transformed from the state shown by solid lines in FIG. 6 (a rectangular linkage) to the state shown by chain lines in FIG. 6 (a parallelogram-shaped linkage). Reference numeral 77 designates a double-action air cylinder which is swingably mounted via a support 81 and a pin 82 and which is connected to the arm 72 via a pin 83. Also, the air cylinder 77 is fed with air via an electromagnetic valve (not shown) so that the cap conveying portion of the cap take-out device 45 can be displaced via the arm 72 to the position shown by chain lines.

Reference numeral 78 designates a chain tension roller for tensioning a chain 80, numeral 76 designates a guide rail for the chain 80, numeral 74 designates a stopper mounted to a fixed portion for limiting the degree of swinging motion of a cap conveying portion (the portion shown by chain lines) via the arm 72*a*, and this stopper 74 restrains the amount of movement in the direction of arrow h of the cap conveying portion upon the lowering of the capping head 46 in the direction of arrow g when capping of the containers 38 is effected as shown in FIG. 5(*d*). Reference numeral 75 designates a stopper mounted to a fixed portion for limiting movement of a cap conveying portion (the portion shown by solid lines) via the arm 72, and this stopper 75 is a positioning stopper for aligning the capping head 46 with the centers of the caps 41 when the caps 41 are gripped by the capping head 46 as shown in FIG. 5(*c*).

Now the operation of the illustrated embodiment will be described. The capping station D in FIGS. 2 and 3 comprises a single aligning device 43 and two cappers 95 and 95*a* (each capper including a capping head 46 having 2 head elements). The caps 41 are aligned along a predetermined direction in the cap aligning device 43, and the caps 41 are conveyed to the cap take-out devices 45 in the two cappers 95 and 95*a* via two rows of chutes 42.

Next, as shown in FIG. 5(*a*), when the cap 41 has been conveyed to the outlet of the chute 42, the motor 70 in the cap take-out device 45 is driven by a signal sent from a control device (not shown), the chain 80 is revolved via the sprocket 71 in the direction of arrow e and the caps 41 are taken one by one from the tip end of the chute 42. More particularly, a member of caps 41 as used in one cycle (in the illustrated embodiment, since 4 caps are used in one cycle, two caps for each side) are removed by a plurality of cap pickers 44, and when the caps 41 have been conveyed to predetermined positions, the motor 70 is stopped by a signal. In this case, the cap take-out device 45 assumes the position shown by chain lines in FIG. 6.

Thereafter, when the conveyance of a predetermined number of caps 41 has been completed, the air cylinder 77 is actuated by compressed air via the electromagnetic valve (not shown) controlled by a control device (not shown), the cap take-out device 45 is moved via the arm 72 from the position shown by chain lines to the position shown y solid lines (moved in the direction of arrow f in FIG. 5(*b*)), and it is stopped at the position where the centers of the head elements in the capping head 46 nd the centers of the caps 41 on the cap take-out device 45 are aligned with each other, as positioned by the stopper 75. It is to be noted that the indexing pitches of the cap pickers 44 and the capping head elements of the capping head 46 are identical.

When the cap take-out device 45 has moved to the position shown by solid lines in FIG. 6 as described above and stops at the position where the caps 41 and the head elements of the capping head 46 are centered with each other, the head elements of the capping head 46 (in the illustrated embodiment, two head elements on one side and four head elements in total) mounted to a driving device (not shown) simultaneously descend a predetermined amount (descend in the direction of arrow j in FIG. 5(*c*)) in response to a signal, then the capping head 46 grips the caps 41 as controlled by a control device (not shown), and after the capping head 46 has risen to a predetermined position (in the direction of arrow k in FIG. 5(*c*)), it stops there.

As soon as the capping head 46 returns to the predetermined position while gripping the caps 41, the air cylinder 77 is actuated by compressed air via the electromagnetic valve controlled by the control device, the cap take-out device 45 is returned from the position shown by solid lines to the position shown by chain lines, and it stops there.

Meanwhile, the movable type of carrier 37 which accommodates and conveys a plurality of containers 38 stops at the position centered with the capping head 46, and at the same time, centering is effected by a control device and a positioning device (not shown), and the carrier 37 is held at the centered position. Subsequently, the capping head 46 descends to a predetermined position (in the direction of arrow g in FIG. 5(*d*)) as controlled by the control device, and when the capping head 46 has finished the capping of the containers 38, it releases the caps 41 as controlled by the control device, and rises (in the direction of arrow i in FIG. 5(*d*)) to return to a predetermined position. It is to be noted that when the caps 41 are screw caps, the capping head elements in the capping head 46 are continuously rotated by means of a device not shown. In a packaging operation in which two or more containers are placed in a case as arrayed in a single row, the capping head 46 could be provided only on one side of the filling and casing line.

In the following, the detailed structure of a grip block device 160 in a container gripper device according to the present invention which can be employed in the uncasing station B and the casing station F in the lines shown in FIGS. 1 and 2, will be described with reference to FIGS. 8 through 13. It is to be noted that while the container gripper 39 in FIGS. 1 and 2 consisted of four container gripper elements, in the embodiment described hereunder, a different container gripper consisting of eight container gripper elements is provided.

In FIGS. 8 to 13, reference numeral 112 designates a motor bracket which is fixedly secured to a movable frame (not shown) of a container gripper device that is movable across a case conveying device 31 and a carrier conveying device 36. Reference numeral 113 designates an electric motor fixedly secured to the motor bracket 112 for rotating the grip block device 160 by 90° in the clockwise or counterclockwise direction, numeral 114 designates a coupling member for coupling the motor 113 with a shaft 115, numeral 116 designates a nut for threadedly connecting the shaft 115 with a connecting rod 117, numeral 118 designates a pair of left and right side plates fixedly secured to the opposite ends of the connecting rod 117, and numeral 119 designates a pair of cylinder brackets each fixedly secured to the respective side plates 118.

Reference numeral 121 designates a pair of cylinders which are pivotably supported from the cylinder brackets 119 via corresponding pins 120, numeral 122 designates a shaft coupled to tip ends of respective rods of the pair of cylinders 121 and adapted to slide along elongated holes 118*a* formed in the side plates 118 in accordance with the extension and retraction of the rods of the cylinders 121, and reference numeral 123 designates levers respectively pivotably supported from the shaft 122 and a pin 124, two such levers 123 forming a pair. The pins 124 are loosely fitted in insert holes of levers 123, 125 and 127, and four pins 124 form a pair. The levers 125 are pivotably supported from the pins 124 and a shaft 126, and two levers 125 form a pair. Reference numeral 126 designates a shaft loosely fitted in a pair of bearings 129. The above-mentioned levers 127 are pivotably supported from the pins 124 and a shaft 128, and two levers 127 form a pair. Reference numeral 128 designates a shaft loosely fitted in an insert hole of the lever 127, and numeral 129 designates a pair of bearings fixedly secured to the respective side plates 118.

Reference numeral 130 designates a cylinder fixedly secured to the pair of side plates 118, and numeral 131 designates a pin loosely fitted in an insert hole of the tip end of the rod of the cylinder 130 and an insert hole of the pin 132. The pin 132 is fixedly secured to a connecting plate 136. Reference numeral 133 designates a shaft fixedly secured to the pair of side plates 118. In addition, a pair of blocks 134 are fixedly connected by the connecting plate 136, holes for allowing the shafts 133 to pass therethrough are formed in the blocks 134 and the shafts 133 are loosely fitted in the holes so that the blocks 134 can slide along the shafts 133. In addition, holes for allowing a shaft 137 to pass therethrough are formed in the blocks 134 in a direction orthogonal to the shafts 133 so that the pair of blocks 134 can be pivotably supported by the shaft 137. Reference numeral 135 designates other blocks having holes for allowing the shaft 133 to pass therethrough and pivotably supported by the shaft 133, which blocks 135 are slidable along the shaft 133 and have other holes for allowing a shaft 137 to pass therethrough in the direction orthogonal to the shaft 133 formed therein. And, a pair of these blocks 135 are pivotably supported by the shaft 137. The shafts 137, respectively, pivotably support each of the pairs of blocks 134 and 135. Reference numeral 138 designates holders having holes for allowing the shaft 128 to pass therethrough, further having holes for allowing the shaft 137 to pass therethrough in a direction orthogonal to the first-mentioned holes formed therein, pivotably supported by the shaft 128 and the shaft 137 and slidable along the shaft 122 or 128 and the shaft 137. Reference numeral 39' designates container gripper elements fixedly secured to the holder 138 for gripping the containers.

Reference numeral 140 designates a connecting rod disposed at right angles to the connecting rod 117, numeral 141 designates a pair of guide plates having a channel-shaped groove formed therein and fixedly secured to the connecting rod 140 for guiding rollers 147 in the vertical directions, numeral 142 designates pins fixedly secured to the blocks 134 and 135, numeral 143 designates a pair of pins loosely fitted in the insert holes of the levers 144 and 145, four such pins 143 forming one set, numeral 144 designates a pair of levers pivotably supported by the pins 142 and 143, four such levers 144 forming one set, and numeral 145 designates a pair of levers pivotably supported by the pins 142, 143 and pin 146, four such levers 145 forming one set. Also, the roller 147 is pivotably supported by the pin 146 and is mounted on the lever 145. Reference numeral 148 designates spacer receivers fixedly secured on the side plates 118 for mounting spacers 150*a* and 150*b* thereto, and reference numerals 149*a* and 149*b* designate spacers mounted to the opposite end portions and the center portion, respectively, of the shafts 133.

Now the operation of the above-described grip block device 160 will be described. By introducing and ejecting air into and from the air cylinder 121 with the aid of actuating means (not shown), the rod of the air cylinder 121 is extended and retracted, so that the shaft 122 can be moved in the left and right directions as shown by arrows 1 in FIG. 8. In addition, the shaft 128 is also moved to the left and to the right like the shaft 122 via the levers 127 and 125 which can rotate about a fulcrum defined by the shaft 126. Accordingly, the blocks 138 loosely fitted around the shafts 122 and 128 also slide along the shafts 137, and hence the container gripper elements 39' respectively fixed to the corresponding blocks 138, which serve as holders for the gripper elements 39', have their spacing in the X-direction in FIG. 8 reduced to $X_1$ in FIG. 11 when the rod of the air cylinder 121 is "retracted", but have their spacing in the X-direction expanded to $X_2$ in FIG. 11 when the rod of the cylinder 121 is "extended". The stroke can be changed by replacing the spacers 150*a* and 150*b*.

With regard to the other air cylinder 130, the rod is extended and retracted by introducing and ejecting air to and from the cylinder. Hence, the blocks 134 slide along the shafts 133, and due to the fact that the rollers 147 slide vertically along the grooves in the guide plates 141, and the blocks 135 also slide along the shafts 133. Accordingly, the holders 138 for the gripper elements 39' connected to the blocks 134 and 135 via the shafts 137 slide along the shafts 122 and 128, and therefore, the container gripper elements 39' fixedly secured to the holders 138 have their spacing in the Y-direction in FIG. 8 reduced to $Y_1$ in FIG. 10 when the rod of the air cylinder 130 is "retracted", but have their spacing in the Y-direction expanded to $Y_2$ in FIG. 10 when the rod of the air cylinder 130 is "extended". The stroke can be changed by replacing the spacers 149*a* and 149*b*. It is to be noted that so long as the accommodation of containers in each casing is consistent, even if the size of the handled containers should change, the above-described mechanism can be expanded or contracted to any arbitrary pitch within a certain adjustable range by replacing the spacers 149*a*, 149*b*, 150*a* and 150*b*, and so, a change in the type of containers to be handled can be easily accommodated for.

Figure 12:
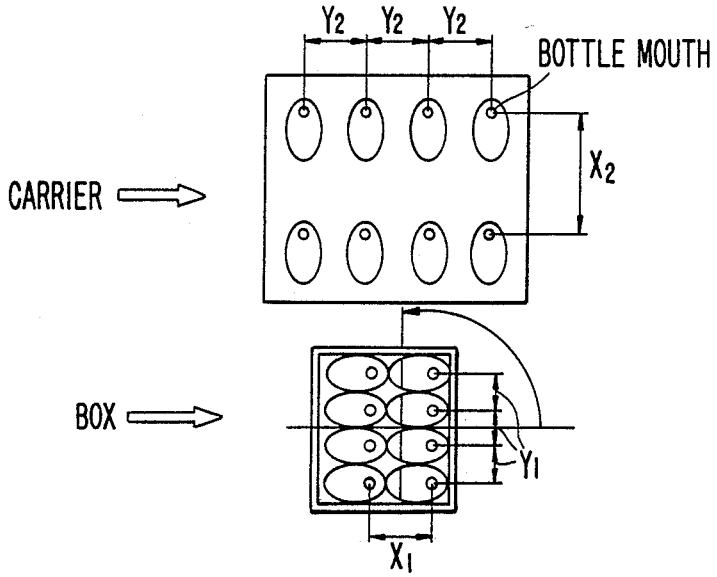
FIGS. 12 and 13 are schematic views respectively showing the state of counterclockwise rotation of the front side of the bottle mouths and the state of clockwise rotation of the rear side of the bottle mouths under the condition of accommodating containers having their eccentric bottle mouths from a carrier into a case.
Figure 13:
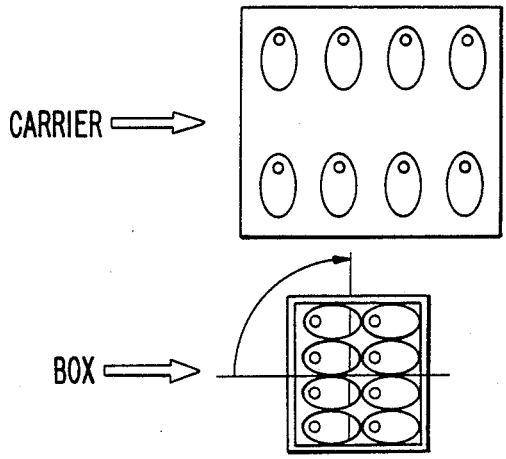
Figure 14:
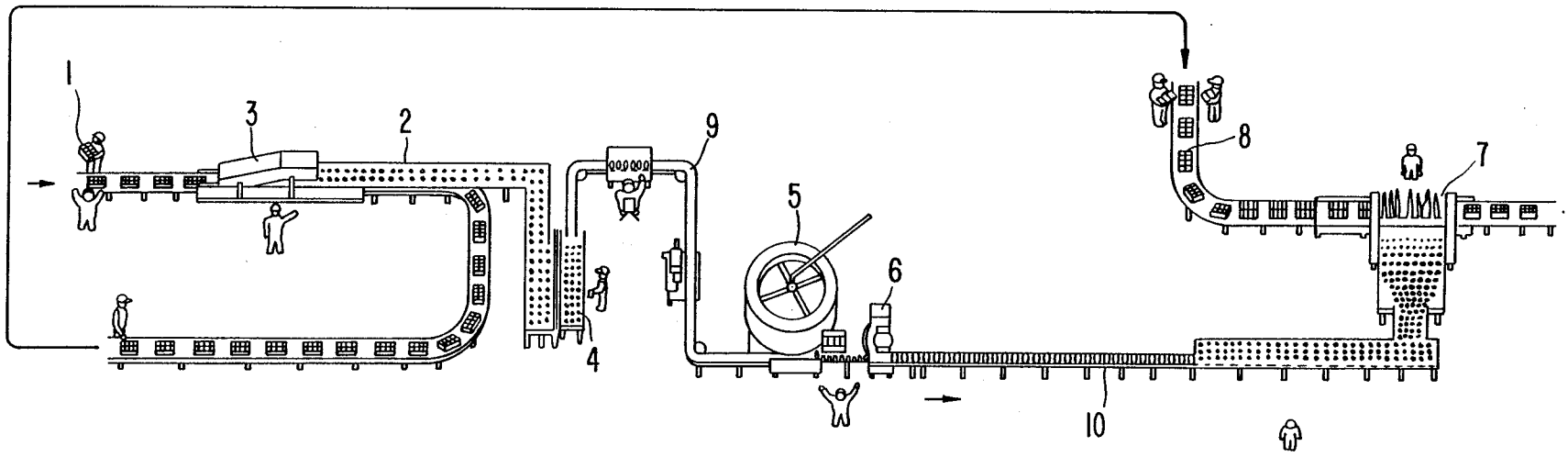
FIG. 14. (PRIOR ART)
FIG. 14 is a general perspective view showing an outline of the operation of a bottling system in the prior art.

As best seen in FIGS. 12 and 13, when handling containers having an eccentric bottle mouth, in the step preceding the step of taking the containers from a case, a signal representing whether the bottle mouth exists on the front side or on the rear side, with respect to the traveling direction of the case, is received, and so, the line can be adapted to the incoming case by rotating the container grip block device 160 by 90° either in the clockwise direction or in the counterclockwise direction by means of the motor 113 depending upon the received signal, during the period when the container grip block device 160 is moved from above the case conveying device to above the carrier conveying device. It is to be noted that the mouths of the containers within the carrier must be oriented in the same direction in view of the structure of the filling machine, the capping machine and the casing machine. The casing machine of the casing station F has a similar structure for taking containers from a carrier and packaging them in a case.

As described in detail above, the present invention provides a composite apparatus in which the various stations in the filling and casing line in the prior art have been integrated, which can dispense with the conveyors and aligning devices connecting the respective instruments as necessitated in the prior art and which has made it possible to simplify the entire system. As a result, the distances between instruments on the line are short, monitoring and manipulation of the instruments is easy, and so, the personnel required for monitoring and manipulation is greatly reduced. Furthermore, even if the type of containers to le handled is changed, component parts to be replaced are few, and therefore, the time required for adapting the invention to accommodate for the new type of containers is short.

In addition, the above-described capping machine according to the present invention can smoothly cap containers held under the condition that a plurality of containers are accommodated as one unit in a conveying box such as a carrier. Also, the machine can effect a take-out operation of caps adapted to the array and number of containers accommodated in a carrier (even when the number of containers in changed), and further, the machine can be easily adapted to accommodate for a change in cap size, and in the array and number of containers by replacing, mounting or dismounting take-out pickers. Furthermore, the machine provides an advantage in that caps are aligned by making use of a single aligning device; then they are divided into a plurality of chutes and can be fed to a plurality of cappers through the chutes.

Still further, as described in detail above, the container gripper device according to the present invention can be easily adapted to handle containers by replacing a few parts even if the size of the containers is changed, and so, the time required for adapting the invention to accommodate for a change in the containers can be reduced. In addition, even when removing bottles having a bottle mouth that deviates from the center of the bottle, an aligning device for orienting the bottle mouths in a case in a predetermined direction prior to gripping the containers with the container gripper device becomes unnecessary.

While the present invention has been described above in connection to preferred embodiments of the invention, it is a matter of course that many apparently widely different embodiments can be made without departing from the spirit of the present invention, and so, all matter contained in the above description and illustrated in the accompanying drawings should be interpreted to be illustrative and not limitative of the invention.

What is claimed is:

1. A container filling system comprising a case conveying device for conveying cases, a carrier conveying device disposed adjacent and parallel to said case conveying device for conveying carriers capable of accommodating and holding containers, an uncasing station including a container gripper device movable between said case conveying device and said carrier conveying device for taking containers from cases conveyed by said conveying device and placing them in carriers conveyed by said carrier conveying device, a filling station including a filling head for filling containers disposed in carriers conveyed by said carrier, and a capping station including a capping machine for capping containers filled by said filling head, said uncasing station, said filling station and said capping station being disposed in succession along said case conveying device and said carrier conveying device.

2. A system as claimed in claim 1, in which said capping machine comprises a cap feeding device for successively feeding caps, cap pickers adapted to respectively support caps fed by said feeding device, and a cap take-out device including said cap pickers, said cap pickers movable between positions associated with the feeding of caps and with the capping of containers in carriers conveyed by said carrier conveying device.

3. A system as claimed in claim 2, in which said capping machine has a plurality of said cap take-out devices, said cap feeding device feeds caps to said plurality of cap take-out devices , said cap feeding device comprising a chute having a plurality of branches for feeding a plurality of rows of caps.

4. A system as claimed in claim 1, in which said container gripper device comprises a grip block device including spaced apart grippers, means for automatically adjusting the spacing between said grippers when the gripper device is above the case conveying device and when the gripper device is above the carrier conveying device, and a rotary device for rotating the grip block device 90° in clockwise and counterclockwise directions.

* * * * *